United States Patent [19]

March

[11] 3,958,676

[45] May 25, 1976

[54] LUGGAGE CASE WITH SOFT SIDED EXTERIOR

[75] Inventor: Joseph Eugene March, Chicago, Ill.

[73] Assignee: Platt Luggage, Inc., Chicago, Ill.

[22] Filed: Jan. 20, 1975

[21] Appl. No.: 542,180

[52] U.S. Cl. ..... 190/49; 190/26

[51] Int. Cl.[2] ..... A45C 13/30; A45C 3/00

[58] Field of Search ..... 190/49, 26

[56] References Cited

UNITED STATES PATENTS 2,532,154 11/1950 Duskin ..... 190/26

*Primary Examiner*—William Price
*Assistant Examiner*—Douglas B. Farrow
*Attorney, Agent, or Firm*—Fitch, Even, Tabin & Luedeka

[57] ABSTRACT

A luggage case is provided with the appearance of a soft sided luggage case; but with superior strength afforded by two opposed interior concave inner shells of molded plastic structural material, pivotally mounted for opening and closing. The luggage case is sufficiently strong to carry tools and other equipment used to clean business machines. Outer coverings of decorative vinyl or the like are joined as by stitching to the inner shells proximate the peripheries of the inner shells and are free to flex and to be displaced relative to the inner shells to provide a soft outer appearance and feel. Preferably, a tough vinyl beading is secured around the peripheral corners of the luggage case to prevent abrasion of the decorative vinyl coverings.

8 Claims, 3 Drawing Figures

LUGGAGE CASE WITH SOFT SIDED EXTERIOR

This invention relates generally to luggage and, more particularly, to an improved luggage case having substantial structural integrity and yet providing the appearance and feel of so-called soft sided luggage.

A popular style of luggage employs a flexible decorative material such as leather, vinyl or canvas, to form the case or bag. The material is supported about the edges thereof by a rigid frame with the large side walls being unsupported and hence being "soft sided." The appearance of this so-called soft sided luggage is attractive and, in the case of leather or vinyl, is often very rich or luxurious; but it cannot withstand rugged and prolonged usage without a substantial deterioration in appearance.

For some purposes, the employment of soft sided luggage has heretofore been impractical. This is particularly true in situations wherein the material to be carried within the luggage case is subject to damage or is exceedingly heavy, such as tools, because the soft material of which the sides of the luggage case are constructed does not provide sufficient rigidity.

Although excellent rigidity has been obtained with the use of molded plastic shells or with metal walls for the luggage case, the appearance of such luggage cases does not match that of the soft sided luggage. Attempts to improve the appearance of such luggage cases such as laminating a plastic layer thereto have met with some limited success, however, the luxuriant and rich appearance of soft sided luggage has heretofore not been achieved.

It is a general object of the present invention to provide an improved luggage case of the foregoing kind.

It is another object of the invention to provide a luggage case having the appearance and the feel of soft sided luggage while at the same time having the substantial structural rigidity of a molded plastic shell luggage case.

A further object of the invention is to provide a luggage case comprised of inner concave shells of molded plastic structural material and outer coverings affording the soft outer appearance and feel of soft sided luggage.

Other objects of the invention will become apparent to those skilled in the art from the following description, taken in connection with the accompanying drawings wherein.

Figure 1:
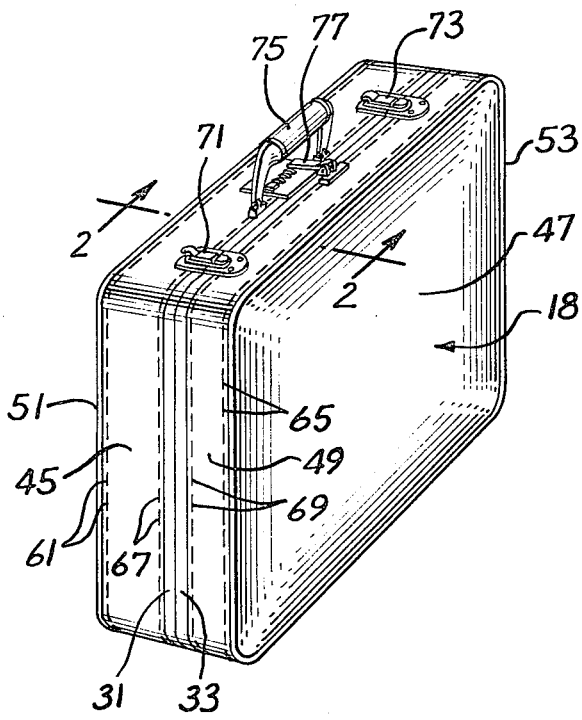
FIG. 1 is a perspective view of a luggage case constructed in accordance with the invention.

Very generally, the luggage case of the invention comprises two opposed concave inner shells 11 and 12 of molded plastic structural material. Each inner shell defines a recess having a peripheral edge, 13 and 14, surrounding the recess. Means 15 and 16 pivotally mount the shells for movement between a closed position (FIG. 1) in which the shells define a closed volume to an open position (FIG. 3) in which the recesses defined by the shells are exposed. Two outer coverings 17 and 18 of flexible decorative material having the appearance of soft sided luggage are nested over the inner shells without being laminated thereto throughout their coextensive facing surfaces as would destroy the soft sided luggage look. The outer coverings 17 and 18 define recesses having peripheral edges 19 and 20, respectively, surrounding the recesses. Each of the inner shells 11 and 12 is nested in a respective one of the outer coverings 17 and 18 and the latter are joined to the inner shells proximate the peripheral edges of the inner and outer shells. The outer coverings are fitted to the inner shells to be closely adjacent thereto and are free to flex and displace slightly relative to the inner shells providing the unsupported appearance and feel of soft sided luggage. A slight air space may exist between the coverings and the inner shells throughout most of their facing sides.

Figure 2:
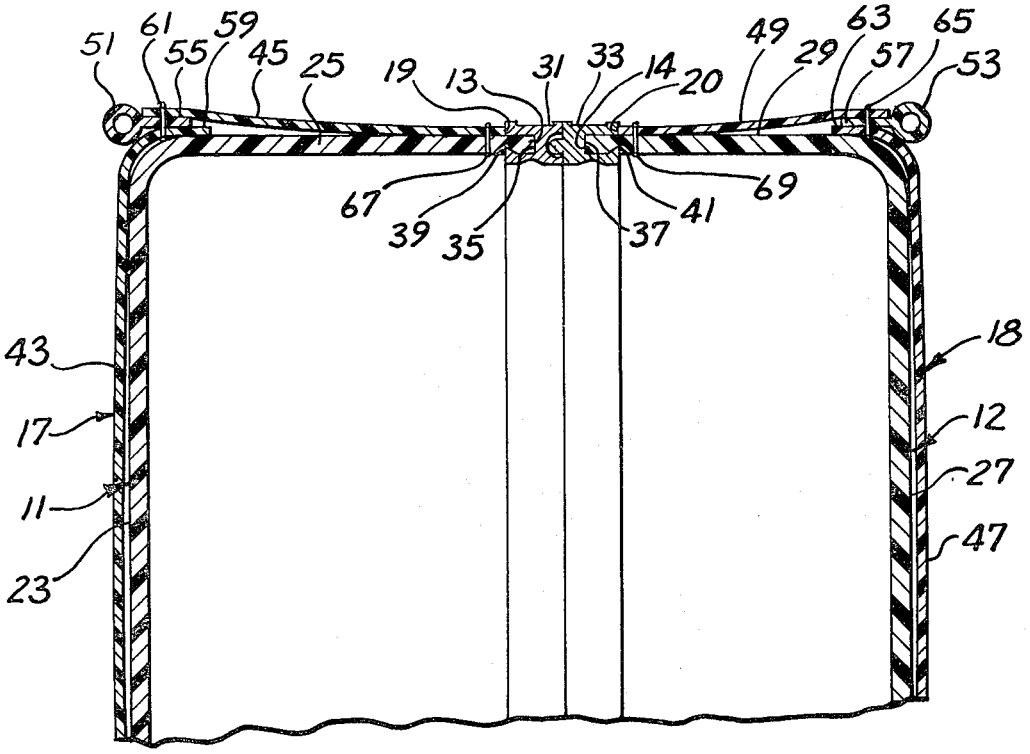
FIG. 2 is a sectional view of the luggage case of FIG. 1 taken along the line 2—2 of FIG. 1.

Referring now more particularly to the drawings, and especially FIG. 2, the luggage case of the invention comprises the two opposed concave inner shells 11 and 12. The shells 11 and 12 are preferably comprised of a molded material and are preferably identical in shape so that they may be formed in the same mold. The shells may be fabricated of a light-weight material such as by molding a laminate of or a single sheet of plastic material into a concave or hollow configuration.

The shell 11 comprises a central panel 23 and a peripheral side wall 25 disposed at an angle to the central panel 23 and encircling the same. Similarly, the inner shell 12 comprises a central panel 27 and an integral peripheral side wall 29 disposed at an angle to the central panel 27 and encircling same. The side wall 25 terminates in the peripheral edge 13, and the side wall 29 terminates in the peripheral edge 14. The peripheral edges 13 and 14 lie in respective planes and surround the recess defined by their respective shells 11 and 12. The central panels 23 and 27 are substantially rectangular and flat but may be bowed outwardly slightly if desired. The integral side walls 25 and 29 preferably flare outwardly from the respective central panels 23 and 27 at an angle slightly greater than 90° to the central panels.

In order to provide further strength and rigidity to the shells 11 and 12, valences 31 and 33 are attached to the peripheral edges 13 and 14, respectively. The valences 31 and 33 are formed with recesses 35 and 37, respectively, which receive the peripheral edges 13 and 14 of the shells 11 and 12. Projections 39 and 41 on the valences 31 and 33, respectively, crimp the valences to the side walls 25 and 29 to retain the valences in place. The valences have outer edges which meet and mate in a tongue and groove relationship when the shells 11 and 12 are disposed in the closed position. The valences may be extruded in the form of long straight strips which are bent to a generally rectangular shape during fabrication of the case.

The outer soft sided covering 17 includes a generally flat central panel 43 and an encircling soft gusset or side wall 45 projecting outwardly of the central panel. Similarly, the outer soft sided covering 18 includes a generally flat central panel 47 and an encircling soft gusset or side wall 49 projecting outwardly thereof.

For the purposes of protecting the "soft sided" central panel 43 and the soft gusset walls 45 and 49 from scuffing and abrasion, beadings 51 and 53 surround the outer peripheral edges of the luggage halves and will rest on whatever surface supports the luggage whether it is opened or closed. The beadings 51 and 53 are preferably formed of an extruded vinyl having good abrasion resistance as compared to the vinyl material of central panels and gussets. A flange 55 projects from the beading 51 and a flange 57 projects from the beading 53. Herein, the outer portion 59 of the panel 43 is bent or folded around the corner between the central panel 23 and the side wall 25. The side wall 25, the flange 55, and the portion 59 of the central panel 43 are attached by sewing with thread 61 such that the flange 55 lies between the side wall 45 and the folded or bent over portion 59 of the central panels 43. A similar arrangement is provided for the central panel 47 by the bent over region 63, sewn to the flange 57 and the side wall 49 by threads 65. The illustrated beadings have a general annular cross section and project outwardly of the planes of the gussets and the central panels. The luxurious looking vinyl of the covering would abrade too rapidly at the corners if the tough wear resistant beading were not provided.

In this instance, the outer soft sided covering 17 is attached to the inner shell 11 at the side walls 45 and 25 proximate the peripheral edge 13 of the side wall 25 and the peripheral edge 19 of the side wall 45 by a stitching means in the form of threads 67. Similarly, the outer soft sided covering 18 is attached to the inner shell 12 at the side walls 49 and 29 near the peripheral edges 20 and 14 thereof, respectively, by a stitching means in the form of sewn threads 69. The peripheral edge 19 of the side wall 45 abuts the valence 31 and the peripheral edge 20 of the side wall 49 abuts the valence 33, thus forming a neat outer appearance for the luggage case.

The use of the sewn threads 61, 65, 67 and 69 add to the appearance of soft sided luggage exterior as contrasted to a typical laminate wall construction for attache cases where no threads are used. The particular locations of the threads may be varied from that shown herein and still fall within the invention herein claimed. It will be appreciated that the coverings may be joined directly to the valences rather than sewn to the shells 11 and 12.

The outer soft sided coverings 17 and 18 are made of a size such that, when sewn in position and as may be seen in FIG. 2, the outer shells are snugly adjacent the inner shells. The flexibility and softness of the outer coverings allow them to flex and to be displaced slightly relative to the inner shells in a manner which provides a soft outer appearance and feel similar to that of soft sided luggage. In the illustrated embodiment, the only substantial attachment between the outer coverings 17 and 18 and their respective inner shells 11 and 12 is at the threads 67 and 69. Some minimal exceptions are described below.

Completing the luggage case of the invention is the usual hardware. Thus, closure devices or latches 71 and 73 are provided, as well as a carrying handle 75. In addition, a tongue and suitable locking device 77 is provided adjacent the handle. The two inner shells 11 and 12 are hinged together by hinges 15 and 16, shown in phantom in FIG. 3.

The result of the foregoing construction is a luggage case in which very heavy objects may be carried with adequate support and which at the same time has an exterior with a soft outer appearance and feel. More particularly, and as may be seen in FIG. 3 wherein the luggage case of the invention is shown in an open condition, the interior of the luggage case is divided into compartments by divider walls 81 and 83 which are molded integral with the shell panel 23 and side wall 25. The divider walls 81 and 83 add additional rigidity to the shell 11. To hold the two shells 11 and 12 in the open position, two sets of braces 85 and 87 are provided. The set of braces 85 includes an arm 89 pivotally attached at the interior surface of the side wall 25 by a rivet 91, and an arm 93 pivotally attached to the interior surface of the side wall 29 by a rivet 95. Similarly, the set of braces 87 is provided with an arm 97 pivotally attached to the interior of the side wall 25 by a rivet 99 and a further arm 101 pivotally attached to the interior of the side wall 29 by a rivet 103.

The illustrated embodiment of the invention is designed as a carrying case for tools for repairing business machines and the like. The internal divider walls 81 and 83 provide four trays and assist in segregating various tools and parts to be carried in the case of the invention. One tray may carry a compressor or blower and another tray may carry a hose for connection to the compressor to blow material from the business machine. A third tray may carry large tools and the fourth may carry clear boxes containing parts.

An envelope insert 105 is riveted by rivets 107 to the side wall 29.

A flexible web 113 is provided inside of the luggage case extending over the hinged area and is secured to the shells 11 and 12 by suitable rivets 115. An attachment strap 117 extends from the side wall 29 and is secured thereto by a rivet 119.

Although the rivets 91, 95, 99, 103, 107, 111, 115 and 119 extend through the side walls 45 and 49 of the "soft sided" coverings 17 and 18, and thereby form additional points of attachment between the outer coverings and the inner shells 11 and 12, the fact that the rivets are located only in the side walls 25 and 29, together with the limited area of attachment which they provide, does not significantly detract from the softness and flexibility of the outer shells. The same is true of the latches 71, 73, 77, the handle 75, and the hinges 15 and 16.

Figure 3:
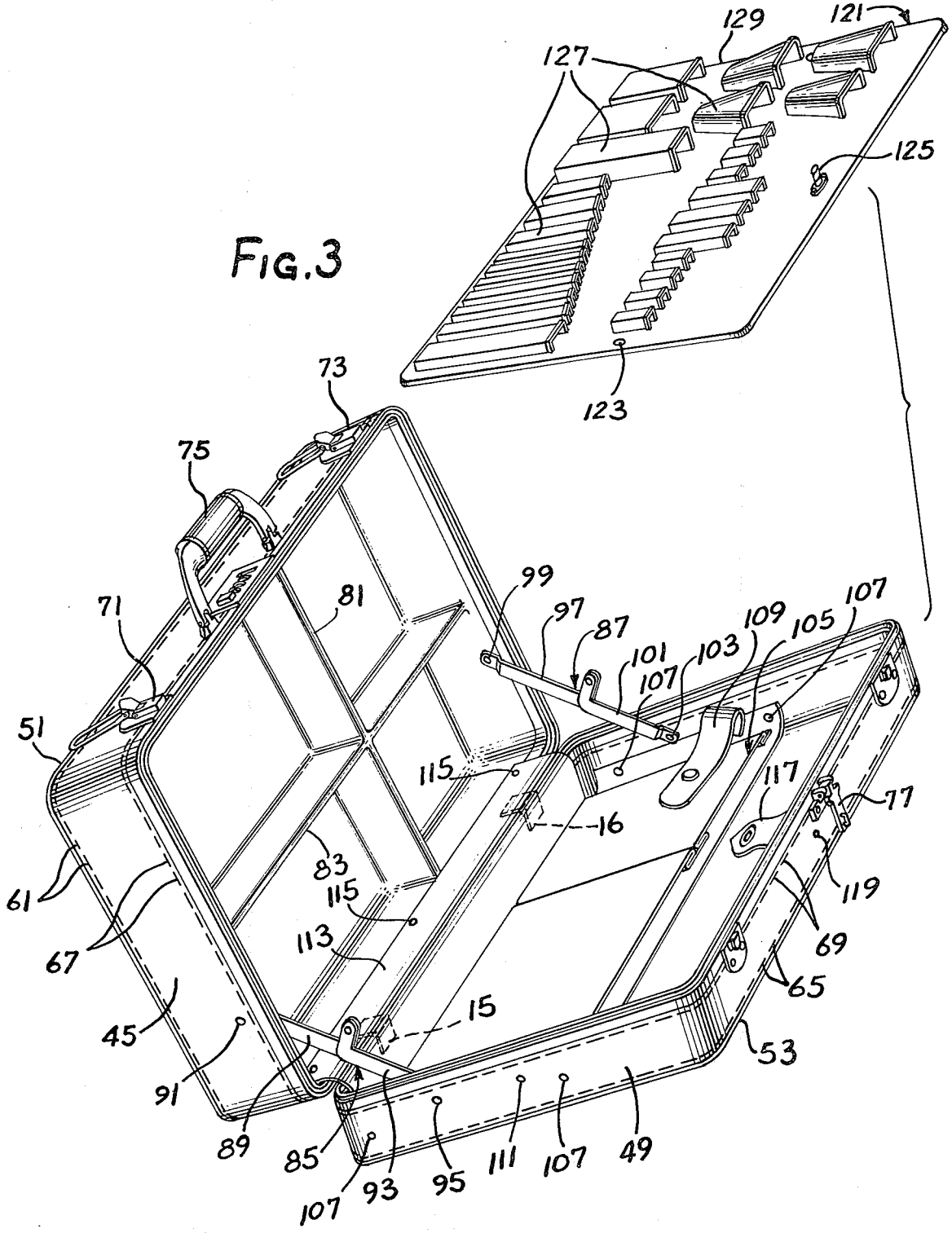
FIG. 3 is a perspective view, partially exposed, of the luggage case of FIG. 1 in the open condition.

A tool holder pallet 121, shown in exploded relationship in FIG. 3, fits within the illustrated case and is secured therein by straps 109 and 117. Attachment straps 109, only one of which is visible, are provided attached to the side wall 27 by rivets 111. Suitable attaching devices 123 and 125 are provided on the pallet 121 for this purpose. The pallet 121 also contains a plurality of variously sized and shaped receptacles 127 for the purpose of holding different sizes and shapes of tools and parts. The receptacles 127 are molded integrally with the pallet 121, extending from a planar base 129.

The pallet 121 can be placed in the case, with all the tools and parts designed to fit within the case being in place. The case may be then closed to the condition shown in FIG. 1. It may be seen that when in the later condition, the case presents the outward appearance of an ordinary attache case. Moreover, the manner of construction previously described provides an outer covering which is soft and flexible to the touch, and which has the appearance of a very high quality attache case with soft or flexible walls. Nevertheless, the luggage case of the invention is capable of carrying contents having very high weight, e.g., 25 to 35 pounds, without diminishing from the exterior appearance of the case. Alternatively or additionally, the case is capable of carrying easily damaged or delicate contents with the rigidity of the case providing adequate protection.

It may be seen, therefore, that the invention provides an improved luggage case which has the outer appearance of soft sided luggage and yet is capable of handling extremely heavy or delicate loads.

Various modifications of the invention in addition to those shown and described herein will become apparent to those skilled in the art from the foregoing description and the accompanying drawings. Such modifications are intended to fall within the scope of the appended claims.

I claim:

1. A luggage case comprising two opposed concave inner shells of structural material, each defining a recess and having a peripheral edge surrounding said recess, means pivotally mounting said shells for movement between a closed position in which said shells define a closed volume to an open position in which said recesses defined by said shells are exposed, and two outer coverings of flexible material, each defining a recess having a peripheral edge surrounding said recess, each of said inner shells being substantially covered by a respective one of said outer coverings and the facing sides thereof being substantially unattached throughout large areas to allow said outer coverings to flex relative to said inner shells; means fixedly securing each of said two outer coverings in a non-detachable manner proximate the peripheries of said inner shells and said outer coverings leaving said substantially unattached large areas, and valence means joined to said inner shells about their peripheral edges for cooperative engagement when the luggage case is closed.

2. A luggage case according to claim 1 wherein each of said outer coverings comprises a central panel, a gusset projecting outwardly therefrom, and means stitching each of said gussets to one of said panels.

3. A luggage case according to claim 2 wherein a beading surrounds a corner of each of said coverings and projects outwardly therefrom to protect the latter.

4. A luggage case according to claim 1 wherein each of said outer coverings comprises a central panel and a gusset projecting outwardly of said central panel and attached thereto around the periphery of said central panel, a beading surrounding said central panel at the region of the attachment of said central panel and said gusset, said bead having a flange extending therefrom between said central panel and said gusset, said flange being attached to both said central panel and said gusset.

5. A luggage case comprising two opposed concave inner shells of structural material, each defining a recess and having a peripheral edge surrounding said recess, means pivotally mounting said shells for movement between a closed position in which said shells define a closed volume to an open position in which said recesses defined by said shells are exposed, and two outer coverings of flexible material, each defining a recess having a peripheral edge surrounding said recess, each of said inner shells being substantially covered by a respective one of said outer coverings and the facing sides thereof being substantially unattached throughout large areas to allow said outer coverings to flex relative to said inner shells, valence means joined to said inner shells about their peripheral edges for cooperative engagement when the luggage case is closed, and joining means comprising stitching means stitching said outer coverings to said inner shells proximate said peripheries of said inner shells and outer coverings and constituting the only substantial attachments therebetween.

6. A luggage case comprising two opposed concave inner shells of structural material, each defining a recess and having a peripheral edge surrounding said recess, means pivotally mounting said shells for movement between a closed position in which said shells define a closed volume to an open position in which said recesses defined by said shells are exposed, and two outer coverings of flexible material, each defining a recess having a peripheral edge surrounding said recess, each of said inner shells being substantially covered by a respective one of said outer coverings and the facing sides thereof being substantially unattached throughout large areas to allow said outer coverings to flex relative to said inner shells, valence means joined to said inner shells about their peripheral edges for cooperative engagement when the luggage case is closed, at least one of said inner shells being comprised of molded plastic with integral wall dividers therein to form trays and to strengthen said shell, and said outer coverings being comprised of vinyl sheets.

7. A luggage case for carrying tools comprising two opposed concave shells of molded plastic, each shell including a central panel and an integral side wall projecting outwardly from said central panel, a valence of extruded metal secured to the outer edge of each of said side walls, said valences being formed with mating configurations, means for pivotally mounting said shells for movement between a closed position in which said valences are engaged in mating relationship and an open position in which the interior of said case is exposed, an outer panel of flexible material covering each of said central panels, an outer gusset of flexible material covering each of said side walls, means stitching said outer panel to said outer gussets around the periphery of said central panel, means stitching each of said gussets to a respective one of said side walls of said shells proximate said valences, said outer panels being free to flex relative to said central panels of said shell to provide a soft outer appearance and feel of soft sided luggage.

8. A luggage case in accordance with claim 7 in which internal walls are molded integral with one of said shells to form compartments therein and to stiffen said shell and in which a tool carrying pallet means is fastened to one of said shells.

* * * * *

UNITED STATES PATENT AND TRADEMARK OFFICE

CERTIFICATE OF CORRECTION

Reexam.
PATENT NO. : B1 3,958,676

DATED : June 21, 1988

INVENTOR(S) : Joseph E. March

It is certified that error appears in the above-identified patent and that said Letters Patent is hereby corrected as shown below: On the title page:

In the Abstract, line 8, change "switching" to --stitching--.

Signed and Sealed this

Seventh Day of February, 1989

*Attest:*

DONALD J. QUIGG

*Attesting Officer*

*Commissioner of Patents and Trademarks*

REEXAMINATION CERTIFICATE (869th)

United States Patent [19]

March

[11] B1 3,958,676

[45] Certificate Issued Jun. 21, 1988

[54] LUGGAGE CASE WITH SOFT SIDED EXTERIOR

[75] Inventor: Joseph E. March, Chicago, Ill.

[73] Assignee: Platt Luggage, Inc., Chicago, Ill.

Reexamination Request:
No. 90/001,210, Apr. 6, 1987

Reexamination Certificate for:

| | |
|---|---|
| Patent No.: | **3,958,676** |
| Issued: | **May 25, 1976** |
| Appl. No.: | **542,180** |
| Filed: | **Jan. 20, 1975** |

[51] Int. Cl.[4] ..... A45C 3/00; A45C 13/30

[52] U.S. Cl. ..... 190/125; 190/26; 190/126; 190/127; D3/76

[58] Field of Search ..... 190/26, 28, 40, 109-111, 190/122-127; 220/22; 206/372, 373, 561

[56] References Cited

U.S. PATENT DOCUMENTS

| | | | |
|---|---|---|---|
| 2,889,020 | 6/1959 | Kotkins | 190/28 |
| 2,937,728 | 5/1960 | Koffler | 190/110 |
| 3,258,017 | 6/1966 | Albert | 206/561 X |
| 3,313,382 | 4/1967 | Rosing et al. | 190/123 |
| 3,608,682 | 9/1971 | Newton et al. | 190/125 |

FOREIGN PATENT DOCUMENTS

| | | | |
|---|---|---|---|
| 269957 | 5/1927 | United Kingdom | 190/124 |
| 1376198 | 12/1974 | United Kingdom | 190/124 |

*Primary Examiner*—Stephen Marcus

[57] ABSTRACT

A luggage case is provided with the appearance of a soft sided luggage case; but with superior strength afforded by two opposed interior concave inner shells of molded plastic structural material, pivotally mounted for opening and closing. The luggage case is sufficiently strong to carry tools and other equipment used to clean business machines. Outer coverings of decorative vinyl or the like are joined as by switching to the inner shells proximate the peripheries of the inner shells and are free to flex and to be displaced relative to the inner shells to provide a soft outer appearance and feel. Preferably, a tough vinyl beading is secured around the peripheral corners of the luggage case to prevent abrasion of the decorative vinyl coverings.

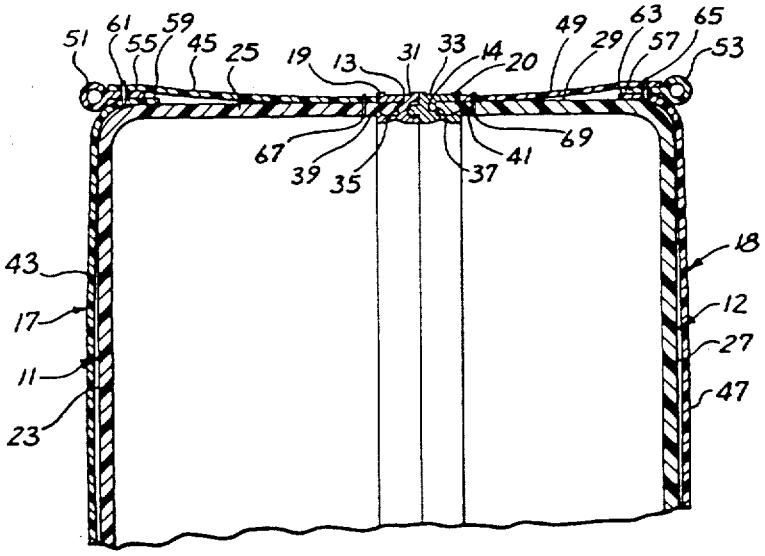

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4 and 6–8 are cancelled.

Claim 5 is determined to be patentable as amended.

New claims 9 and 10 are added and determined to be patentable.

5. A luggage case comprising two opposed concave inner shells of structural material, each defining a recess and having a peripheral edge surrounding said recess, means pivotally mounting said shells for movement between a closed position in which said shells define a closed volume to an open position in which said recesses defined by said shells are exposed, and two outer coverings of flexible material, each defining a recess having a peripheral edge surrounding said recess, each of said inner shells being substantially covered by a respective one of said outer coverings and the facing sides thereof being substantially unattached throughout large areas to allow said outer coverings to flex relative to said inner shells, valence means joined to said inner shells about their peripheral edges for cooperative engagement when the luggage case is closed, and joining means comprising stitching means stitching said outer coverings to said inner shells proximate said [peripheries] *peripheral edges* of said inner shells and outer coverings and constituting the only substantial attachments therebetween.

*9. A luggage case comprising two opposed concave inner shells of structural material, each shell being of one-piece construction and defining a recess before being brought into association with any other component of said case, and having a peripheral edge surrounding said recess, means pivotally mounting said shells for movement between a closed position in which said shells define a closed volume to an open position in which said recesses defined by said shells are exposed, and two outer coverings of flexible material, each defining a recess having a peripheral edge surrounding said recess, each of said inner shells being substantially covered by a respective one of said outer coverings and the facing sides thereof being substantially unattached throughout large areas to allow said outer coverings to flex relative to said inner shells; means fixedly securing each of said two outer covering in a non-detachable manner proximate the peripheral edges of said inner shells and said outer coverings leaving said substantially unattached large areas, and valence means joined to said inner shells about their peripheral edges for cooperative engagement when the luggage case is closed, each of said outer coverings comprising a central panel and a gusset projecting outwardly of said central panel, said gusset having a first end stitched to said central panel proximate the periphery of said central panel, said first end not being stitched to its corresponding shell, said gusset having a second end remote from said central panel, said means fixedly securing comprising means holding said second end of said gusset so that said central panel and all of said gusset except said second end are substantially unattached to their corresponding shell.*

*10. A luggage case as set forth in claim 1 wherein each of said outer coverings includes a central panel and a gusset projecting outwardly from the central panel, said gusset being connected by stitching to said central panel about the periphery of said central panel, said stitching not connecting the covering to the outer shell whereby said means for fixedly securing leaves all of said central panel and all of said gusset except the portion thereof proximate the peripheral edge of the inner shell substantially unattached.*

* * * * *